US007219749B2

(12) United States Patent
Kuckes

(10) Patent No.: US 7,219,749 B2
(45) Date of Patent: May 22, 2007

(54) SINGLE SOLENOID GUIDE SYSTEM

(75) Inventor: Arthur F. Kuckes, Ithaca, NY (US)

(73) Assignee: Vector Magnetics LLC, Ithaca, NY (US)

( * ) Notice: Subject to any disclaimer, the term of this patent is extended or adjusted under 35 U.S.C. 154(b) by 256 days.

(21) Appl. No.: 10/950,688

(22) Filed: Sep. 28, 2004

(65) Prior Publication Data

US 2006/0065441 A1 Mar. 30, 2006

(51) Int. Cl.
*E21B 7/04* (2006.01)
*E21B 47/022* (2006.01)

(52) U.S. Cl. ..... 175/45; 175/61; 175/62; 324/326; 324/346

(58) Field of Classification Search ..... 166/255.1; 175/62, 26, 73, 45, 40; 33/304, 310, 313; 702/6, 9; 324/326, 345, 346, 352, 370
See application file for complete search history.

(56) References Cited

U.S. PATENT DOCUMENTS 3,465,834 A * 9/1969 Hamilton, Jr. ..... 173/2
3,529,682 A * 9/1970 Coyne et al. ..... 175/45
3,712,391 A 1/1973 Coyne
4,875,014 A 10/1989 Roberts et al.
5,258,755 A * 11/1993 Kuckes ..... 340/853.5
5,513,710 A 5/1996 Kuckes
5,675,488 A * 10/1997 McElhinney ..... 702/10
5,923,170 A 7/1999 Kuckes
6,315,062 B1 * 11/2001 Alft et al. ..... 175/45
6,417,666 B1 * 7/2002 Mercer ..... 324/326
6,466,020 B2 10/2002 Kuckes et al.
6,470,976 B2 * 10/2002 Alft et al. ..... 175/61
6,480,119 B1 * 11/2002 McElhinney ..... 340/853.8
6,543,550 B2 * 4/2003 Hall ..... 175/26
6,626,252 B1 9/2003 Kuckes
6,736,222 B2 5/2004 Kuckes et al.
6,814,163 B2 11/2004 Kuckes
6,980,123 B2 * 12/2005 Fling ..... 340/853.3
2002/0140429 A1 * 10/2002 Mercer ..... 324/326

* cited by examiner

*Primary Examiner*—David Bagnell
*Assistant Examiner*—David Andrews
(74) *Attorney, Agent, or Firm*—Jones, Tullar & Cooper, P.C.

(57) ABSTRACT

Measurement of the location and direction of a drill head in a borehole extending beneath an obstacle such as a body of water utilizes a single AC solenoid at a known location but having an unknown orientation. The measurements are used to direct the path of the borehole.

14 Claims, 4 Drawing Sheets

SINGLE SOLENOID GUIDE SYSTEM

BACKGROUND OF THE INVENTION

The present invention relates, in general, to a method and apparatus for tracking and guiding the drilling of generally horizontal boreholes below the earth's surface, and more particularly to an improved system and apparatus for tracking a borehole being drilled generally horizontally under an obstacle such as a river, where access to the surface of the ground immediately above the borehole is difficult. Measurements of borehole location and direction are made for use in guiding the borehole to a specified location.

Horizontal directional drilling techniques are well known, and have long been used to drill boreholes which cross under areas where trenching is not permitted or is impractical. For example, such techniques are used to drill boreholes under manmade or natural obstacles such as rivers, lakes, or other bodies of water, under highways, airport runways, housing developments or the like. These boreholes may be used to position pipelines, underground transmission lines, communications lines such as optical fibers and other utilities, for example, and often must be drilled within defined areas, must travel long distances, and must exit the ground at predetermined locations. The borehole typically is tunneled from an entry point on the earth's surface at the near side of an obstacle, travels under the obstacle, and exits the ground at a predetermined location on its far side. In drilling such boreholes it is important to maintain them on a carefully controlled track following a prescribed drilling path, or proposal, for often the borehole must remain within a right of way as it passes under the obstacle and its entry and exit points on opposite sides of the obstacle must often be within precisely defined areas.

Conventional directional drilling apparatus for drilling such boreholes commonly incorporates a steering tool which measures the borehole inclination, magnetic azimuth, and tool roll angle with respect to the earth's gravity and magnetic field at each station where measurements are made. The borehole coordinates are computed and tabulated from these steering tool data as a function of the measured distance along the borehole, which may be referred to as the measured depth of the steering tool. These borehole coordinates suffer from serious cumulative effects produced by inclination and azimuth determinations made at spaced locations along the borehole, and by the lateral errors generated by conventional borehole surveying techniques. The inherent imprecision of these techniques is the reason for turning to electromagnetic methods for directly determining drill bit location.

Prior systems such as those illustrated in U.S. Pat. Nos. 4,875,014 and 3,712,391 provide guidance for the drilling of boreholes, but in some circumstances present problems to the user since they require access to the land above the path to be followed by the borehole. These systems utilize surface grids or other guidance systems on the earth's surface, but the access they require often is not available.

U.S. Pat. Nos. 5,513,710 and 6,626,252 overcome the foregoing problem by providing drilling guidance methods and systems for drilling boreholes under rivers and under obstacles, the '710 patent utilizing a direct current powered solenoid at a known location with respect to the target exit for the borehole, and the '252 patent utilizing two horizontal AC solenoids near a borehole path on the surface of the earth at the far side of the obstacle.

The foregoing systems require precise location and orientation of the solenoids used to provide the magnetic fields, and this can be an inconvenience in some circumstances and impossible in others, where there may not be access to an appropriate location for the solenoids or where there is not sufficient time to carry out the required orientation procedure. Thus, there is a need to provide a simple, yet accurate system for detecting and tracking the drill stem used to produce an underground borehole, where a magnetic field source such as a solenoid can be deployed in a body of water, for example, above the path of the borehole being drilled, and where it is not necessary to determine the orientation of the source.

SUMMARY OF THE INVENTION

In accordance with the present invention, the precise location of a drill bit while drilling under an obstacle such as a body of water is determined by the use of a single solenoid at a known location above the borehole path, wherein the solenoid has an unknown orientation. For example, when a borehole is being drilled under a river, a single solenoid may be carried to an appropriate location in the river above the desired path of the borehole, and the solenoid lowered to the bottom of the river and energized to produce an alternating current magnetic field. The location of the solenoid can be accurately determined, as by triangulation from the shore and from a measurement of its depth below the surface of the river. However, the direction of the axis of the solenoid when it rests on the bottom of the river is unknown.

The drill head to be located and tracked is in the borehole beneath the riverbed, and includes standard measurement while drilling (MWD) sensors so that the direction of the drill head with respect to the Earth's magnetic field and its inclination with respect to the earth's gravity can be used to determine the direction of the borehole. In addition, the depth of the drill head along the borehole is precisely measured. These measurements allow the location of the drill head with respect to the entry point of the borehole on the near side of the river to be determined only approximately, i.e., to the precision given by the standard methods of integrating MWD measurements of the Earth's magnetic field and gravity along the borehole. In accordance with the present invention, the precise drill head location can be determined using the apparatus and method described herein.

During the initial phase of drilling, the process of the present invention is normally used in conjunction with another borehole tracking process which provides insitu measurement of the relative direction of the Earth's magnetic field with respect to an "away" direction from a surface reference, defined by land surveys. Accordingly, during an initial phase of drilling, a tracking method such as that disclosed in U.S. Pat. No. 6,466,020, U.S. Pat. No. 6,626,252B1, or U.S. Pat. No. 4,875,014, for example, is used to determine the borehole coordinates precisely with respect to land survey coordinates; i.e., the away, elevation and right distances (aer coordinates), and to determine the relative direction between the local Earth's magnetic field and the away direction. After this initial phase of drilling, standard tracking methods using the Earth's magnetic field and gravity measurements in the gne coordinate system along the borehole provide an approximate determination of the location where the present invention is to be used.

To provide a precise location of the drill head sensors, and thus the location of the borehole, after the initial phase, in accordance with the invention the solenoid, which is at a known location but at an unknown orientation, is energized and measurements of its field are made at the MWD sensors in the drill head at a first location along the borehole. The drill head is then advanced along the borehole, as by drilling, to a second location and field measurements again are made. The measurements made at these two locations are then mathematically analyzed to determine the location of the drill head relative to the solenoid. Using the precisely known solenoid location, the drill head location can then be related to the overall coordinate system defined by land surveys.

The first step in analyzing the measured AC magnetic field data for determining drill head location is the generation of time reference waveforms, which are synchronized with solenoid switching circuitry for controlling the excitation current. The resulting magnetic field data are measured at two locations and the data are signal averaged with respect to these time reference waveforms to evaluate the solenoid magnetic field vector at each location. These magnetic field vectors, together with the known approximate location vector between the measuring locations are used to compute the relative location vector from the solenoid to the measuring locations in the "gravity, magnetic north, east" (gne) coordinate system which is defined by the measuring instruments in the down hole tool. The relative vector from the solenoid to the current drilling location that is found in this way is then transformed from the tool's gravity, magnetic north, east coordinate system to the land survey system of "away, elevation, right" (aer). This relative drill head location is then readily combined with the land survey defined location of the solenoid to find the location vector of the current drilling location relative to the borehole entry point in the desired land survey coordinates.

BRIEF DESCRIPTION OF DRAWINGS

The foregoing, and additional objects, features and advantages of the present invention will become apparent to those of skill in the art from a consideration of the following detailed description of a preferred embodiment thereof, taken in conjunction with the accompanying drawings, in which.

DESCRIPTION OF PREFERRED EMBODIMENT

Figure 1:
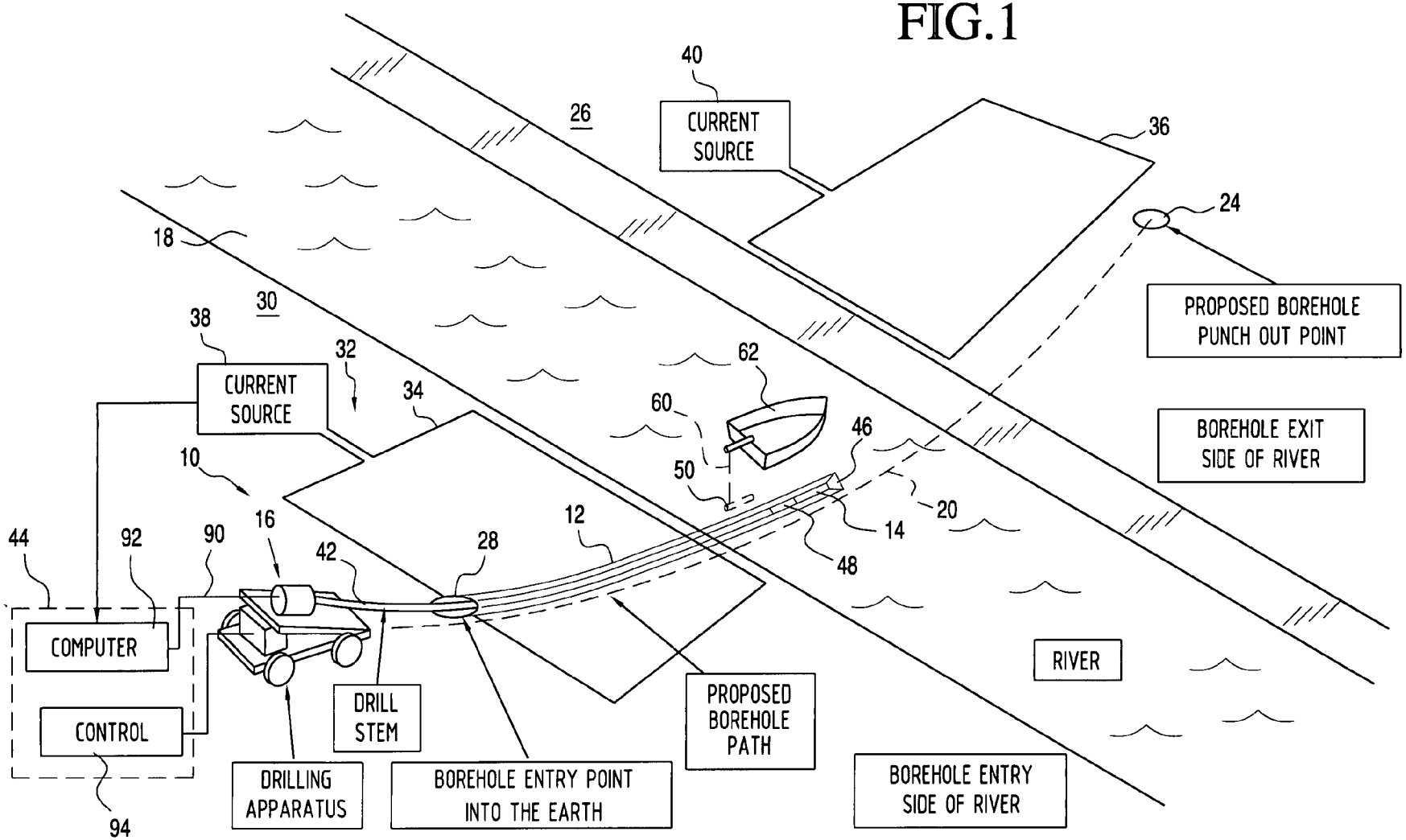
FIG. 1 is a perspective view of a borehole location and guidance system in accordance with the present invention.
Figure 2:
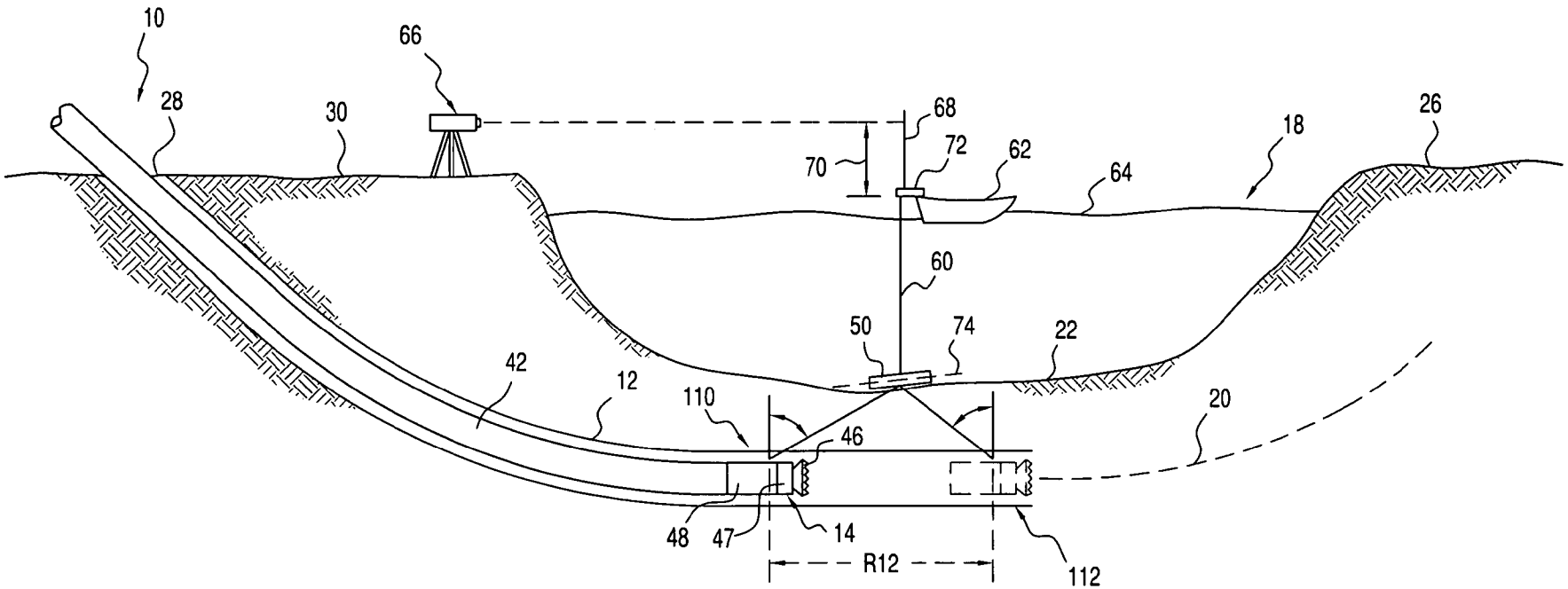
FIG. 2 is a cross-sectional view of the system of FIG. 1.

One embodiment of the apparatus utilized in the method of the present invention for drilling a borehole under an obstacle is generally illustrated at 10 in FIGS. 1 and 2. A borehole 12 is illustrated as being drilled using an industry standard drilling motor in a drill head 14 connected to a drill rig 16. Drilling under an obstacle such as river 18 involves drilling along a planned path 20 at a depth of, for example, 20 meters below the bed 22 of the river to a planned exit location, such as a borehole punch-out point 24, on the far side 26 of the river. This exit location may be 1,000 to 1,500 meters away from a borehole entry point 28 on the near side 30 of the river.

During the initial stage of drilling the borehole 12, the drill enters the earth at the entry point 28, and progresses along the planned path 20 under the guidance of a survey system 32 of the type described, for example, in U.S. Pat. No. 6,466,020, the disclosure of which is hereby incorporated herein by reference. This system includes a loop 34 of wire on the near side 30 of the river, and at least one loop 36 of wire on the far side 26 of the river. As described in the '020 patent, the surface elevation, northing and easting coordinates of multiple points specifying the surface loop configurations for each of loops 34 and 36 are determined using standard land surveying techniques. Logical reference points for each of the loops are the specified borehole entry point 28 and exit point 24 locations associated with each. The entry side loop 34 is powered by a source 38 which may be an alternating current (AC) source or may be a direct current (DC) source which can be turned on and off preferably with reversed current flow polarity, to enable separation of the electromagnetic field generated by the loop from the Earth's magnetic field. Similarly, the loop 36 is powered by a current source 40 which may be an alternating current source or a direct current source that can be turned on and off, preferably with reversed current flow polarity.

The borehole 12 is drilled using drilling apparatus which includes a drill stem 42 of precisely known length, a control unit 44 at the entry end for controlling the direction of drilling, and a drill head 14 at the down hole end of the drill stem 42. The drill head includes a drilling bit 46 driven by a drill motor 47, and an electronic steering tool 48 together with conventional apparatus for communicating steering tool measurements to the Earth's surface. Steering tools, which are standard to the drilling industry, normally incorporate three Earth's magnetic field sensors and three accelerometers. Traditionally, the axial gravity or the axial magnetic field vector component sensors are designated as z axis sensors, while those measuring vector components perpendicular to the borehole axis are perpendicular to each other and are designated as x and y sensors. These sensors are used to determine the drilling direction and the roll angle of the "tool face" for changing the direction of drilling.

In accordance with one form of the present invention, in the initial phase of drilling at the near side of the river 18 or other similar obstacle, the entry magnetic field source loop 34 is energized by a reversible direct current from source 38. This excitation produces a corresponding magnetic field in the Earth in the region of the steering tool, and x, and y, and z electromagnetic field components generated by the loop at a measuring station are found by making two sequential measurements with known positive and negative currents. Usually, currents of approximately 50 amperes in each direction are appropriate. The apparent Earth field values are fractionally weighted by the positive and negative current values, with the sum of these values giving the normally measured Earth field x, y and z components, and the difference of these fields giving the x, y and z electromagnetic components. This method of separating the Earth field and electromagnetic field is simple, well known and straightforward and can be used with any standard steering tool.

The location of the drill head is determined by the process described in detail in the '020 patent, and the drilling of the borehole is guided until it starts to pass under the obstacle 18 and the system 32 loses its effectiveness. At this point, the system and method of the present invention is utilized to guide further drilling of the borehole under the obstacle. To accomplish this, a magnetic field source such as solenoid 50 is located on the riverbed 22 (FIG. 2) generally above the proposed path 20 of the borehole. The solenoid is energizable to produce an alternating current magnetic field that will provide the information needed to guide the drill head 14 as it moves along the path 20 under the river. The electronic steering tool, or instrument package 48 (FIG. 3) incorporates a three-component accelerometer 52 to measure the direction of gravity and a three-component magnetometer 54 to measure alternating magnetic fields. The instrument package preferably is mounted on the drill stem 42 just above the drill head motor 47 and may or may not be part of a conventional measurement while drilling (MWD) package.

Figure 3:
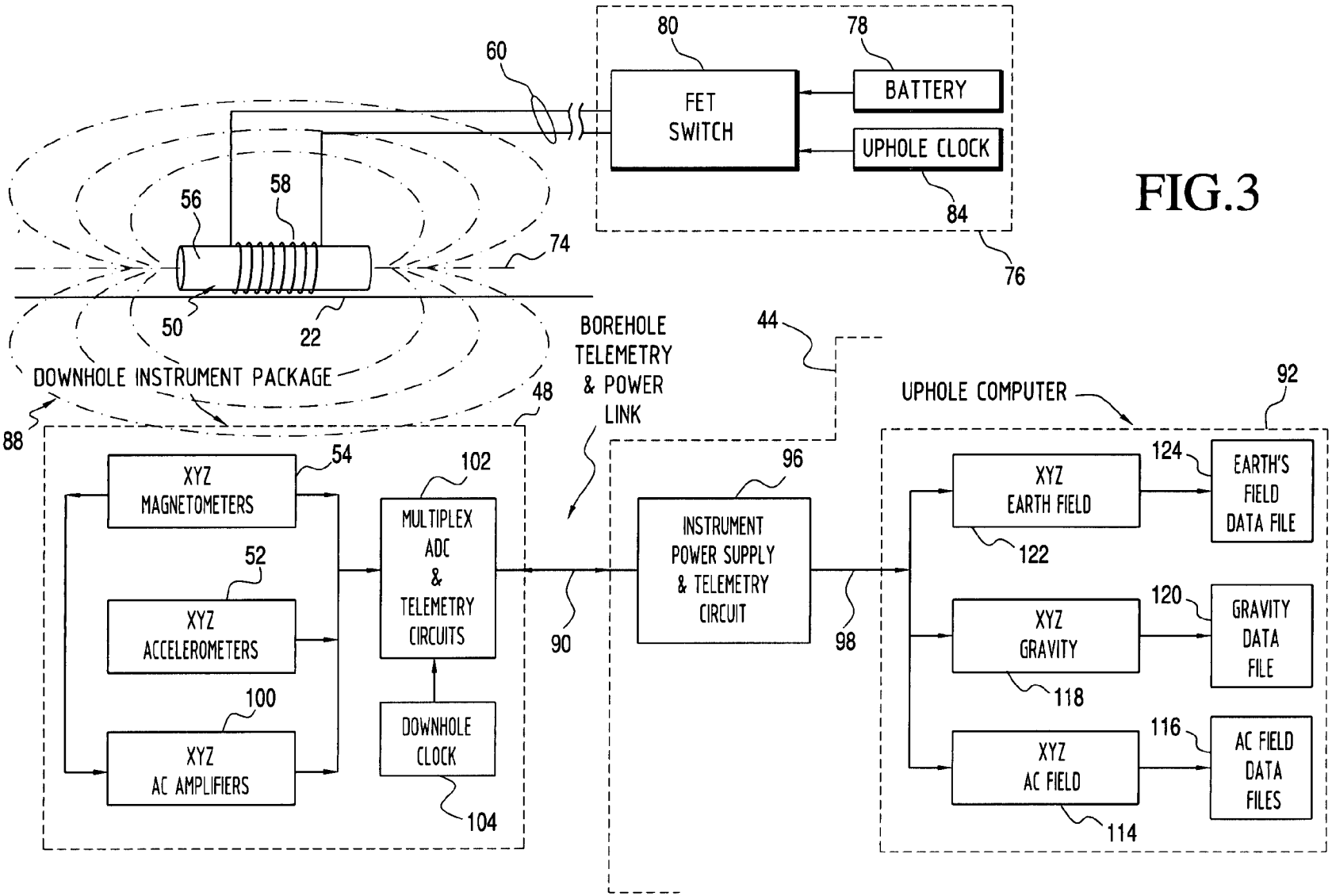
FIG. 3 is a block diagram of the downhole detector circuitry and uphole computer of the system of FIG. 1.

As illustrated in FIGS. 2 and 3, the solenoid 50, which may include a conventional core 56 and coil 58, may be suspended by a cable 60 from a floating platform 62 such as a boat, barge or the like, on the surface 64 of river 18. The location of the solenoid is measured by, for example, conventional surveying equipment 66 on the shore of the river using a marker pole 68 on barge 62 so that the solenoid can be located in azimuth and distance with respect to the location of the entry point 28. By measuring the length of cable 60 and the vertical distance 70 between the connection point 72 of the cable and the horizontal location of the surveying equipment, the elevation of the solenoid can be determined with respect to entry point 28. However, because the shape or slope of the riverbed 22 is unknown, neither the inclination nor the direction of the axis 74 of solenoid 50 is known.

Figure 4A:
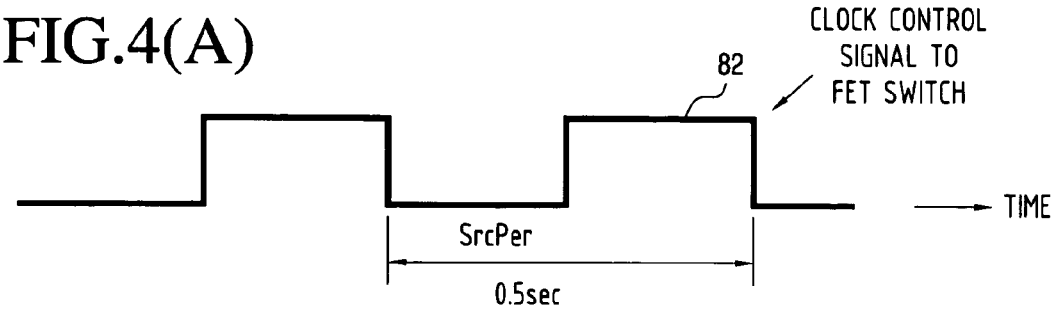
FIG. 4A illustrates the clock signals controlling the power to the magnetic field generating solenoid.
Figure 4B:
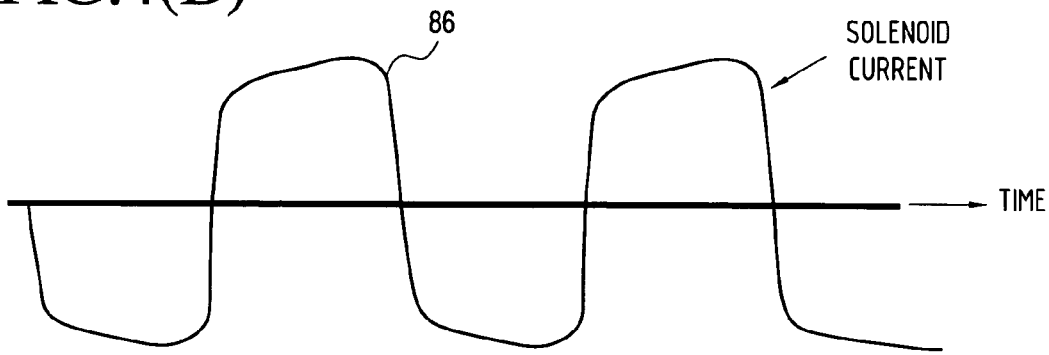
FIG. 4B illustrates the resulting solenoid current.

The solenoid 50 illustrated in FIG. 3 may have, for example, a 23 kilogram laminated core 56 that, in a preferred embodiment, is 1.25 meters long. To provide the desired magnetic field, this solenoid may require 40 watts of power, for example, and this may be supplied by a portable power supply 76 which may be a small, 12 volt lead acid battery 78 connected to a polarity reversing FET (field effect transistor) switch circuit 80 connected across the solenoid winding 58. The direction of electric current flow in the solenoid winding is periodically reversed by the switch circuit to produce a reference square wave with a precise cycle period of 0.5 seconds derived from clock signals 82 (FIG. 4A) generated by a crystal oscillator 84 having a frequency that is precise to a few parts per million. The solenoid current vs. time waveform illustrated at 86 in FIG. 4B produces a magnetic dipole field 88 of alternating polarity. Although the principles of physics governing the behavior of the magnetic fields used in the analysis to be described are those appropriate to time independent magnetic fields, it is desirable to repeatedly reverse the direction of current flow in the solenoid to allow precise separation of the solenoid field from the Earth's magnetic field and from instrument and magnetic field noise. The method is thus readily adapted to manually switching the field of a solenoid and appropriately analyzing the results.

The electromagnetic field 88 generated by the solenoid (FIG. 3) is detected by the downhole instrument package 48. This package is connected by way of a borehole telemetry link 90 to the uphole drilling control unit 44 located at the drilling rig 16 on the earth's surface. The control unit 44 includes a computer 92 for processing data received from the downhole electronics and a controller 94 (FIG. 1) for operating the drill. An instrument power supply and telemetry circuit 96 is connected by way of link 90 to supply power to the downhole measuring instruments and to permit them to transmit data uphole and to convert the data to computer input signals on line 98. The power supply link 90 may be a wire inside the drill stem 42 leading to the downhole instrument package 48.

The package 48 (FIG. 3) includes the three-vector component magnetometer 54 and the three-vector component accelerometer 52, each of which generates output signals with respect to an XYZ set of axes. The Z axis of the instrument package 48 is aligned with the axis of the borehole 12 being drilled, and the perpendicular X and Y axes have a known orientation alignment to the drill face; that is, to the direction of a conventional bent housing in the drilling motor which controls the direction of drilling. Direct current is received from the power supply 96 on the surface to power the instruments. The magnetometer AC outputs are passed through band pass filters and amplifiers 100 and are multiplexed with the magnetometer DC outputs and the accelerometer outputs at a multiplexer 102, where the signals are converted from analog to digital form and put into a form suitable for telemetry to the surface. The timing for digitization and telemetry is generated by a downhole clock 104 controlled by a quartz crystal whose frequency is precise to a few parts per million.

In accordance with the invention, measurements are taken at two locations along the borehole 12 in order to determine the actual path of the borehole being drilled. Thus, for example, a first measurement is taken at a first position generally indicated at 110 in FIG. 2, and thereafter the drill stem is advanced (for example, by drilling) along the borehole to a position indicated at 112. After drilling has been stopped for positioning the drill head at each of the measurement stations 110 and 112 along the proposed borehole path 20, the solenoid 50 is energized from the source 76, which may be located on the platform 62, to produce the reversing field 88. This field is detected by magnetometers 54 and the resulting output signals from the magnetometer are sampled by multiplexer 102 and are transmitted uphole. A few minutes of data are recorded, as indicated at 114 in computer 92, and data files are generated at 116. The drill head is then moved to the second location 112, the solenoid 50 is again energized to create a reversing field which is detected by magnetometers 54, a second set of data are received at 114, and a second set of data files 116 is generated. During each set of measurements the downhole multiplexer circuitry 102 also sequentially samples the output voltages of the accelerometers 52 at fixed time intervals and telemeters the results to the surface computer 92, which receives the gravity measurements at 118 and creates a data file 120. Measurements of the Earth's field are also made by magnetometers 54, are sampled by multiplexer 102, are transmitted uphole to computer 92, where the data is received at 122 and a data file is created at 124. The relative time at which each measurement is made is precisely preserved in the data files by the position it has in the serial data stream being telemetered.

Data Acquisition and Processing

After drilling has been stopped at the first measurement station 110 along the proposed borehole path, the solenoid 50 is energized as described with respect to FIG. 3. The resulting reversing field 88 with an alternating polarity component is detected by magnetometers 54 and the resulting output voltages are transmitted up hole by way of multiplexer 102. The AC field measurements are separated at 114, a few minutes of data are recorded, and an AC field data file is recorded at 116. The earth's field measurements are separated at 122, and the earth's field data is recorded at file 124. During these measurements the down hole multiplexer circuitry 102 also sequentially samples the output voltages of the accelerometers 52 at fixed time intervals and telemeters the results to the surface computer 92, which separates the gravity measurements at 118 from the Earth's field measurements and the AC field measurements, and gravity data is recorded at file 120.

The computer 92 generates from the gravity data in file 120 a 3-row, single column matrix gxyz with elements gx, gy and gz, which are the representation of the measured gravity g in the xyz coordinate system, and from the Earth's field data file 124 a 3-row single column matrix of the Earth's field components Efxyz is generated. From the AC magnetometer measurement data in file 116, a 3-column matrix h1 is generated. It has three columns h1x, h1y, and h1z, which are tabulations of the time sequence of the digitized magnetometer measurement data from the solenoid. The matrix h1 is signal averaged with respect to time to find the solenoid magnetic field vector H1 at location 110, i.e., the three vector components H1x, H1y, and H1z.

Data taken at a second measurement location 112 along the proposed borehole path are analyzed using a similar procedure to compute the magnetic field vector components H2x, H2y, and H2z of the solenoid's field and the matrix vector H2xyz at the second measurement station.

Generation of Reference Signal and Signal Averaging

The first part of the digital analysis procedure includes generating in computer 92 a symmetric reference waveform which is time-synchronized with the uphole solenoid source 76 to determine an optimal time shift from the AC field signals recorded at 114 for a given measuring station. The strongest signal of the 3 magnetic field vector components is selected and processed to find an optimal time shift for location 110. For this purpose, a reference waveform is defined, against which all 3 magnetic field components can be signal averaged. To choose the magnetic field component with the strongest signal, the average square of the three data columns of h1 is computed, using the MATLAB operation "mean(h1.*h1)." The largest of the three numbers found defines the largest vector component of the AC field received, i.e., the column "h1max" which is the appropriate column of h1 from which the time shift between the source clock and the downhole clock is found. The serial telemetry data stream locations assign a time to each of the measurements of h1 max, and those times are put into a single column matrix called Timeh1max. The functional form of the reference wave form to be used is cos(w*t), where w is the fundamental radian frequency of the source, i.e., w=2*pi/SrcdPer, where SrcPer is the source period, i.e., 0.5 sec.

A two-column reference test matrix RefTest is defined with the first column being Reftest1 and the second as Reftest2:

$$\text{RefTest1}=\cos(w*\text{Time}h1\text{max})$$

$$\text{RefTest2}=\cos(w*\text{Time}h1\text{max}-\text{SrcPer}/4)) \quad \text{Eq. (1)}$$

RefTest1 is a single column matrix evaluating cos(w*t) at values of t equal to the times Timeh1max, i.e., the times at which the measurements of h1max were made according to the downhole clock. RefTest2 is a second cosine reference waveform evaluated at times delayed by a quarter time period of the solenoid clock from RefTest1.

$$H\text{maxRef12}=[\text{RefTest1 RefTest2 ones(size}(\text{Time}h1\text{max}))]\backslash h1\text{max} \quad \text{Eq. (2)}$$

HmaxRef12 is a 3-row, 1 column matrix. The first row is the least squares fit of evaluating h1max with respect to RefTest1, the second row is the least squares fit with respect to RefTest2, and the third row is the zero offset of h1max. The optimum time shift (TShft) indicated by HmaxRef12 is:

$$T\text{Shift}=(\text{ScrPer}/4)*a\tan 2(H\text{maxRef12}(2), H\text{maxRef12}(1)) \quad \text{Eq. (3)}$$

All three columns of the data are signal averaged with the time reference matrix to give least squares fits for H1x, H1y and H1z:

$$H1x=\cos(w*(\text{Time}h1x-T\text{shift}))\backslash h1x$$

$$H1y=\cos(w*(\text{Time}h1y-T\text{shift}))\backslash h1y$$

$$H1z=\cos(w*(\text{Time}h1z-T\text{shift}))\backslash h1z \quad \text{Eq. (4)}$$

Timeh1x is a column matrix of the times at which the h1x measurements were made, Timeh1y is a column matrix of the h1y measurements, and Timeh1z is a column matrix of the h1z measurements. Since the reference function cos (w*t) used is symmetric with respect to positive and negative values, there is an intrinsic sign ambiguity in the values of H1x, H1y and H1z and in the sign of the magnetic moment m. This ambiguity in the sign will be addressed below.

This signal averaging method optimally extracts the time variation of all three components, which is in phase with the single reference signal. The method thus gives no information of the relative phases of the three vector components with respect to each other. Since the further analysis of the fields assumes DC behavior of the fields, finding and including quadrature components, i.e., phase information, has the effect of adding random noise into the analysis and degrading the final results obtained.

Fitting the Magnetic Field Measurements to Find Location

Figure 5:
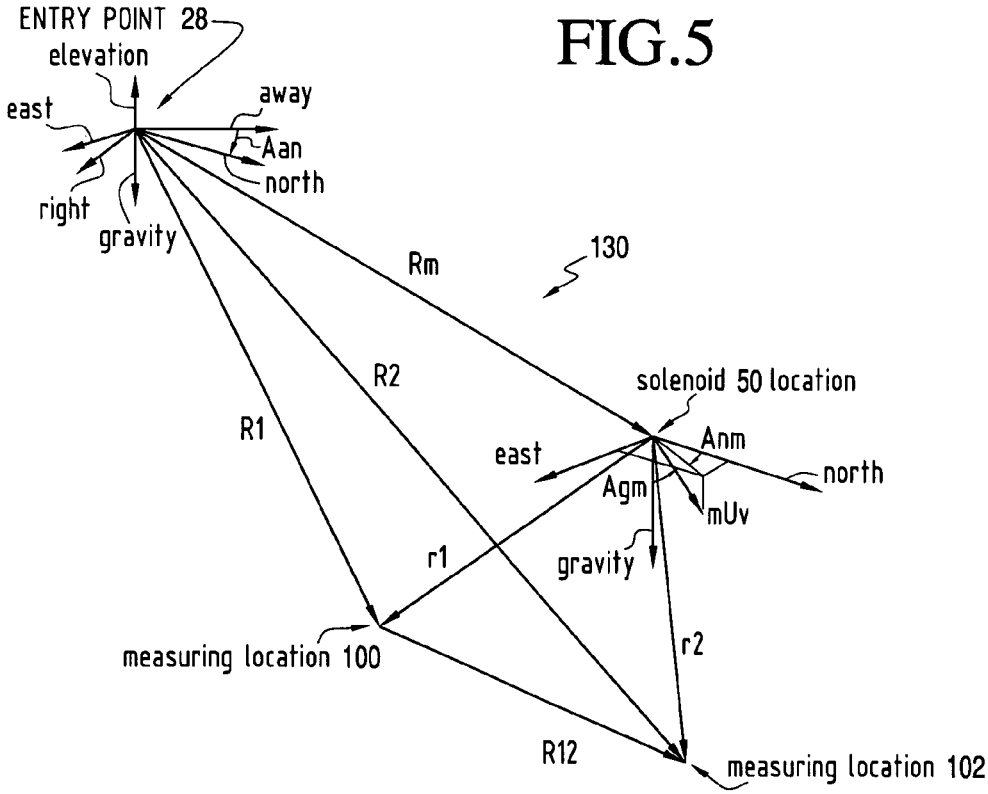
FIG. 5 is a schematic diagram showing the relationship between the location vectors and angles in the aer and gne coordinate systems and the direction of the solenoid with respect to the gne system.

A linear least squares fitting procedure is used to find the optimum value of the location vector r1 of the drilling head 14 when it is at location 110 relative to the solenoid 50, as illustrated in diagram 130 in FIG. 5. To apply this method, it is necessary to know at the outset an approximate value of the unit vector direction m1Uv of solenoid 50. This vector can be computed analytically from measurement data at each of the locations 110 and 112.

Start by noting that the approximate value of the location vector r1 from the solenoid to measurement location 110 is known, since Rsol is known and R1, the location vector of the measurement location 110, is approximately known in the aer (away, elevation and right) coordinate system. Since the angle Aan between magnetic north and the away direction is also known, the representation of r1gne in the gne (gravity, magnetic north, east) coordinate system is also known.

The general theoretical value for H1, i.e., the solenoid field 88 at location 110, is given by the expression:

$$H1\mathbf{32}\ (M\text{mag}/(4*pi*r1\text{Mag}\hat{}3))*(3*\text{dot}(m1Uv,\ r1Uv)*r1Uv-m1Uv) \quad \text{Eq. (4)}$$

At the outset, the value of Mmag, the magnitude of the solenoid magnetic moment, is known and the approximate value of the magnitude of r1 is known. Taking the vector dot product of r1Uv and H1, the value of the vector dot product dot(m1Uv, r1Uv) is readily computed to be:

$$\text{dot}(m1Uv,\ r1Uv)=\text{dot}(H1,\ rUv)/(M\text{mag}/(8*pi*r1\text{Mag}\hat{}3)) \quad \text{Eq. (5)}$$

The value of dot(m1Uv, r1Uv) is readily computed from the known approximate value of r1Uv and the measured value of H1, using their representations in the gne (gravity, magnetic north) coordinate system. The gne representation of the approximate value of r1Uv is readily found using the known angle between the away axis and magnetic north Aan using standard means. To find the transformation matrix from the xyz coordinate system of the downhole tool to the gne system we use the measurements of the Earth's field Efxyz and the gravity gxyz vectors at location 110. The measured unit vector of the magnetic north direction NUvxyz is:

$$NUvxyz=(Efxyz-\mathrm{dot}(Efxyz,\ gxyz)*gxyz)/\mathrm{mag}(Efxyz-\mathrm{dot}(Efxyz,\ gxyz)) \quad \text{Eq. (6)}$$

The unit vector in the East direction is given by the vector cross product:

$$EUvxyz=\mathrm{cross}(gxyz,\ NUvxyz) \quad \text{Eq. (7)}$$

Thus, the transformation matrix converting from the xyz coordinate system the gne coordinate system is:

$$\mathrm{xyztogne}=[\mathrm{gxyz'};\ \mathrm{NUvxyz'};\ \mathrm{EUvxyz'}] \quad \text{Eq. (8)}$$

Thus:

$$H1gne=xyztogne*H1xyz \quad \text{Eq. (9)}$$

Thus, a first approximation to the unit vector of the solenoid direction, in the gne system representation, from measurements at location 110 is given by $$m1Uvgne = \quad \text{Eq. (10)}$$
$$= ((3/2)*\mathrm{dot}(H1gne,\ r1Uvgne)*r1Uvgne - H1gne)/$$
$$(Mmag/(4*pi*r1Mag\wedge 3))$$

Measurements made at a second location 112 defined by the vector r2 from the solenoid 50 to the drill head location are analyzed in the same way to determine H2xyz and a first approximation unit vector:

$$m2Uvgne = \quad \text{Eq.(11)}$$
$$= ((3/2)*\mathrm{dot}(H2gne,\ r1Uvgne)*r2Uvgne - H2gne)/$$
$$(Mmag/(4*pi*r1Mag\wedge 3))$$

Because of the double valued nature of the TimeShft parameter at each location, the directions of the field derived at each location H1 and H2 have an ambiguity of sign, with a corresponding ambiguity in the signs of m1Uv and m2Uvgne. The sign of m1Uv at location 110 is taken as the defining sign and the direction of m1 gne is assigned to be equal to solenoid direction MUvgne. The sign of H2 is adjusted by noting whether dot(m1Uvgne,m2Uvgne) is greater than or less than zero (ideally this dot product should be either +1 or −1). If it is >0 then H2 is not changed; if it is <0 the sign of H2 is changed.

After making this adjustment, the first approximation to the solenoid direction is taken to be the average of m1Uvgne and m2Uvgne, i.e.:

$$mUvgne=(m1Uvgne+m2Uvgne)/2 \quad \text{Eq. (12)}$$

The angle from magnetic north to the solenoid axis Anm and the angle from g to the solenoid axis Agm are given by:

$$Anm=a\ \tan 2(mUvgne(3),mUvgne(2))$$

$$Agm=a\ \tan(\mathrm{sqrt}(mUvgne(2)\hat{}2+\mathrm{sqrt}(mUvgne(3)\hat{}2),\ mUvgne(1)) \quad \text{Eq. (13)}$$

The final step in the analysis is to do a linear least squares fit to find the best values for r2, and the direction of the solenoid unit vector mUvgne. Thus, 5 parameters must be found: 3 for the vector r2gne, and 2 for the direction of mUvgne, to be determined from the six component values H1gne and H2gne. The relationship between r1gne and r2gne is known from the usual method of borehole surveying using the Earth's magnetic field and gravity measurements and the along-the-borehole distance R12 between the locations 110 and 112.

The analysis procedure is to find the values of the parameters defining the solenoid direction, i.e., mUvgne, and the directions of the drill head r2gne and r1gne relative to the solenoid. As indicated, this analysis is done in the gne coordinate system that is the logical one since it is the Earth's field magnetometers and the gravity sensors in the sensor tool 48 which define the "local" coordinate system around the solenoid. The vector R12 connecting locations 110 and 112, shown in FIG. 5, is determined by integrating the measured depth and borehole direction found from Earth's field and gravity measurements, as is standard in the drilling industry. Thus r2 is found from:

$$r2=r1+R12 \quad \text{Eq. (14)}$$

R12 is a known constant vector, thus differential vectors dr1 are equal to differential vectors dr2.

The five parameters to be determined, the solenoid azimuth angle (a) between magnetic north and the solenoid axis, the solenoid inclination with respect to the gravity direction (b), and the 3 vector components of r2 (cde), which is the vector between the solenoid location and the second measurement location 112, referred to as the parameters a, b, c, d, e, will be combined into a 5-parameter column vector abcde. A differential column vector dabcde is the difference between neighboring values of abcde in the usual spirit of differential calculus. All will be done in the gne coordinate system; thus, the gne identifiers will be dropped in the display of the method. Thus:

$$abcde(1)=Anm$$
$$abcde(2)=Agm$$
$$abcde(3)=r2(1)$$
$$abcde(4)=r2(2)$$
$$abcde(5)=r2(3) \quad \text{Eq. (15)}$$

The procedure is to start with the known approximate value of the column vector abcde, i.e., Eq. 15, and to evaluate the theoretical values of the solenoid electromagnetic fields H1 and H2 in the vicinity of the value of abcde in a 5-dimensional Taylor expansion. The differential column vector dabcde relating the value of abcde1 at parameter vector neighboring abcde0 is:

$$abcde1=abcde0+dabcde \quad \text{Eq. (16)}$$

The measured values of the field in the gne coordinate system are H1meas and H2meas; they define a six-parameter column vector H12meas, i.e.:

$$\mathrm{H12meas}=[\mathrm{H1meas};\ \mathrm{H2meas}] \quad \text{Eq. (17)}$$

Likewise, the theoretical value of the fields H1 and H2 define a six-parameter column vector H12th, i.e.:

$$\mathrm{H12th}=[\mathrm{H1th};\ \mathrm{H12th}] \quad \text{Eq. (18)}$$

The value of H12th at parameter location 0 is designated H12th0, that at parameter location 1 as H12th1. The Taylor expansion relating H12th1 to H12th0 can be written as:

$$H12th1=H12th0+dH12dabcde*dabcde \quad \text{Eq. (19)}$$

following the usual procedures of differential calculus. The derivative matrix dH12dabcde has 6 rows and 5 columns. It can be evaluated around the parameter value abcde0 using the partial derivative expressions (using a "delta" value of 0.001):

$$dH12dabcd(:,1)=(H12th(abcde\mathbf{0}+[\mathbf{0.001\ 0\ 0\ 0\ 0}]')-H12th(abcde0))/0.001$$

$$dH12dabcd(:,2)=(H12th(abcde\mathbf{0}+[\mathbf{0\ 0.001\ 0\ 0\ 0}]')-H12th(abcde0))/0.001$$

$$dH12dabcd(:,3)=(H12th(abcde\mathbf{0}+[\mathbf{0\ 0\ 0.001\ 0\ 0}]')-H12th(abcde0))/0.001$$

$$dH12dabcd(:,4)=(H12th(abcde\mathbf{0}+[\mathbf{0\ 0\ 0\ 0.001\ 0}]')-H12th(abcde0))/0.001$$

$$dH12dabcd(:,5)=(H12th(abcde\mathbf{0}+[\mathbf{0\ 0\ 0\ 0\ 0.001}]')-H12th(abcde0))/0.001 \quad \text{Eq. (20)}$$

In expression 20 the quantities between the brackets, e.g. (:,1), denote all the rows of column 1 following the MATLAB convention. Between the brackets on the right side of each expression, the quantity between "(0)" is taken to follow the standard mathematical convention, i.e., (H12th (abcde0+[0.001 0 0 0 0])]) means to evaluate H12th at abcde0+[0.001 0 0 0 0]'. The best "linear least squares" value of the differential column vector dabcde is found by equating the value of H12th1 to H12meas.

Starting with the approximate value of abcde0, a better value abcde1 is found from:

$$dabcde=dH12dabcde\backslash(H12\text{meas}-H12th0) \quad \text{Eq. (21)}$$

and the new value abcde1 is then given by $$abcde1=abcde0+dabcde \quad \text{Eq. (22)}$$

This new value of abcde1 is now used as a new abcde0 and the process is repeated a few times to produce an optimum value for abcde and thus for the solenoid orientation and drill bit position vector r2.

The desired location r2 of the drill bit with respect to the solenoid, expressed in the gne coordinate system of the land survey, is found from the components of the final value of abcde1 using the expression:

$$r2gne=abcde1([\mathbf{3\ 4\ 5}]) \quad \text{Eq. (23)}$$

while the desired location of the drill bit R2, expressed in the aer coordinate system of the land survey, is found from the components of the final value of abcde1 using the expression:

$$R2aer=Rmaer+gnetoaer*r2gne$$

$$gnetoaer=[0\ \cos(Aan)-\sin(Aan);-1\ 0\ 0;\ 0\ \sin(Aan)] \quad \text{Eq. (24)}$$

The error in R2aer due to imprecision of the direction of the Earth's magnetic field relative to the away direction is minimal because in practice RSol is much larger than R2, the distance between the solenoid and the drill bit. On a 1500 meter river crossing project a typical distance between the entry point and the Solenoid is 750 meters and the distance R2 is 30 meters or less so that the effect of error in the true value of the Earth's magnetic field direction used in finding R2 is reduced by a factor of 25. Thus, a 2-degree difference in the Earth's magnetic north direction determined during the initial drilling phase and that at the locations 110 and 112 leads to an error of less than 1 meter for location 112.

The foregoing measurements are repeated at additional measuring points along the borehole as the drilling progresses, with the measured relative drill head locations being used to control further drilling beneath the obstacle 18. When the borehole reaches the far side of the obstacle, represented here by the far side 26 of the river, further drilling of the borehole to the exit point 24 is controlled by measurements of magnetic fields produced by loop 36, again in the manner described in U.S. Pat. No. 6,466,020, for example.

Although the present invention has been described in terms of a preferred embodiment, it will be apparent that modifications and variations may be made without departing from the true spirit and scope thereof. For example, although the process has been described in the context of guiding the drilling of a borehole along a proposed path under an obstacle, it will be understood that it is equally applicable to surveys of existing boreholes. In the latter case, the measuring tool is simply moved along the existing borehole and the measurements are made as described above. If the motion of the measuring tool does not cause the tool to rotate between measuring locations, then it is not necessary to measure the earth's magnetic field or to measure gravity after the first such measurements are made; the original determination of the orientation and direction of the tool can be used at subsequent locations. Accordingly, the scope of the invention is limited only by the accompanying claims.

What is claimed is:

1. A method for determining the location of a borehole with respect to a solenoid, comprising:

placing the solenoid at a known location near the borehole, said solenoid having an axis of unknown orientation;

energizing the solenoid to produce a first corresponding magnetic field;

detecting at a measuring tool at a first measuring point in the borehole the vector components of said first magnetic field, the earth's magnetic field and gravity;

energizing the solenoid to produce a second corresponding magnetic field;

detecting at said measuring tool at a second measuring point in the borehole the vector components of said second magnetic field;

determining the vector from said first measuring point to said second measuring point; and determining from the foregoing the location of said measuring tool with respect to said solenoid.

2. The method of claim 1, wherein determining said location includes relating the relative locations of said measuring tool at said first and second measuring points to a land survey away, elevation and right (aer) coordinate system.

3. The method of claim 2, wherein the borehole has a known entrance point and wherein the location of said solenoid is known with respect to the entrance point in the aer coordinate system.

4. The method of claim 1, wherein determining the vector from the first measuring point to the second measuring point includes measuring the distance along said borehole from said first to said second measuring point.

5. The method of claim 4, wherein determining said vector includes analyzing said Earth's magnetic field vectors and said gravity vectors along said borehole between said first and second measuring points.

6. The method of claim 5, wherein the borehole has a known entrance point and further including determining the location of said solenoid relative to said entrance point in the aer surveyor's coordinate system.

7. The method of claim 6, further including determining from said earth's field and gravity measurements the orientation of said surveyor's coordinate system with respect to the earth's field and gravity (gne) coordinate system.

8. A method for tracking the drilling of a borehole, comprising:

establishing a proposed borehole path;

positioning a magnetic field loop at a known location above a first portion at said path;

energizing said loop to produce a first magnetic field;

initially drilling a borehole from an entrance point;

detecting at a sensor in said borehole said first magnetic field;

locating said sensor and guiding said initial drilling with respect to said proposed path;

placing a solenoid at a known location near a second portion of said proposed path, said solenoid having an axis of unknown orientation;

further drilling a second part of said borehole;

energizing said solenoid to produce a second magnetic field;

detecting vector components of said second magnetic field, the Earth's field and gravity by said sensor at a first measuring point along said second part of said borehole;

detecting vector components of said second magnetic field, the Earth's field, and gravity by said sensor at a second measuring point along said second part of said borehole;

determining the vector from said first measuring point to said second measuring point; and determining the locations of said first and second measuring points with respect to said entrance point and said proposed path.

9. The method of claim 8, wherein locating said sensor is carried out in a surveyors (aer) coordinate system.

10. The method of claim 9, wherein determining the locations of said first and second measuring points is carried out in a gne coordinate system, the method further including converting the gne coordinate system locations to the aer coordinate system for locating said first and second measuring points with respect to said entrance point.

11. The method of claim 8, wherein establishing said proposed path includes establishing a borehole path that extends under an obstacle, and wherein placing said solenoid includes placing the solenoid in said obstacle.

12. The method of claim 8, further including guiding the drilling of said second part of said borehole with respect to said proposed path.

13. The method of claim 12, further including placing a second magnetic field loop above a third portion of said proposed path, for use in guiding the drilling of a third part of said borehole with respect to said proposed path.

14. The method of claim 8, wherein determining the vector from said first measuring point to said second measuring point includes:

energizing said solenoid with a reversible direct current to produce said second magnetic field;

accumulating multiple measurements of said detected vector components for said first measurement point to produce corresponding first data files for said vector components;

accumulating multiple measurements of said detected vector components for said second measurement point to produce corresponding second data files for said vector components; and determining said vector from said first and second data files.

* * * * *